United States Patent [19]

Poston

[11] 4,142,357

[45] Mar. 6, 1979

[54] YARN GUIDE FOR SPINNING OR TWISTING MACHINE

[75] Inventor: William B. Poston, Central, S.C.

[73] Assignee: Sara G. Poston, Central, S.C.

[21] Appl. No.: 870,107

[22] Filed: Jan. 17, 1978

[51] Int. Cl.[2] ..... D01H 7/56; D01H 7/64

[52] U.S. Cl. ..... 57/122; 57/124

[58] Field of Search ..... 57/119–125

[56] References Cited

U.S. PATENT DOCUMENTS

| | | | |
|---|---|---|---|
| 1,905,280 | 4/1933 | Goddard | 57/119 |
| 2,401,249 | 5/1946 | Jones | 57/119 |
| 3,056,250 | 10/1962 | Backus | 57/119 |
| 3,100,374 | 8/1963 | Backus | 57/122 |
| 3,172,249 | 3/1965 | Thomas et al. | 57/119 |
| 3,205,647 | 9/1965 | Matsui | 57/124 |
| 3,583,146 | 6/1971 | Myers | 57/119 |
| 3,785,140 | 1/1974 | Muller | 57/124 X |

*Primary Examiner*—John Petrakes
*Attorney, Agent, or Firm*—B. P. Fishburne, Jr.

[57] ABSTRACT

A free-floating ring is disposed in an annular chamber between a fixed outer ring based on the ring rail and an inner ring which is adjustable up and down axially in relation to the outer ring. The outer ring has circumferentially spaced camming slots in its side wall slidably receiving radial cam pins fixed to the inner adjustable ring. One such cam pin on each inner ring is extended to engage slidably within a slot in an actuating bracket secured to a shifter rod extending longitudinally of the ring rail and guided within bearings on the ring rail. Movement of the shifter rod longitudinally of the ring rail in one direction or the other produces raising or lowering of the gang of inner rings to vary the yarn tension. An opening for yarn threading is provided in the annular side wall of each outer ring.

10 Claims, 5 Drawing Figures

FIG. 1
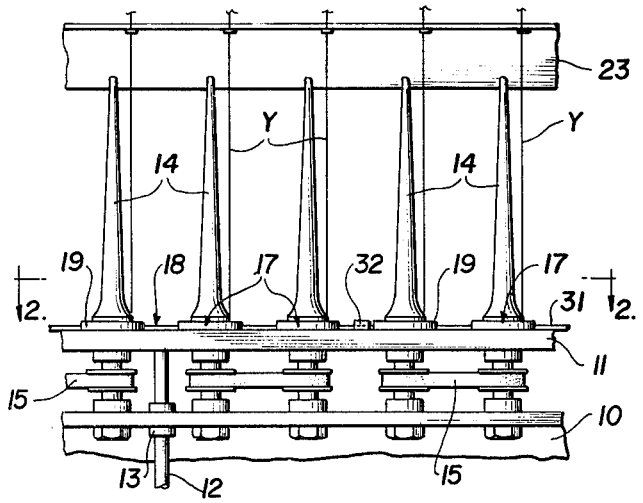
FIG. 5
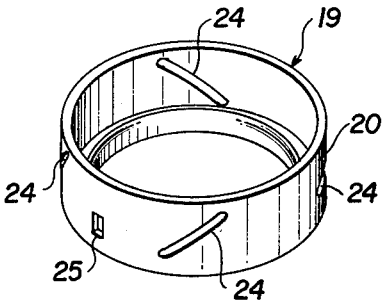
FIG. 2
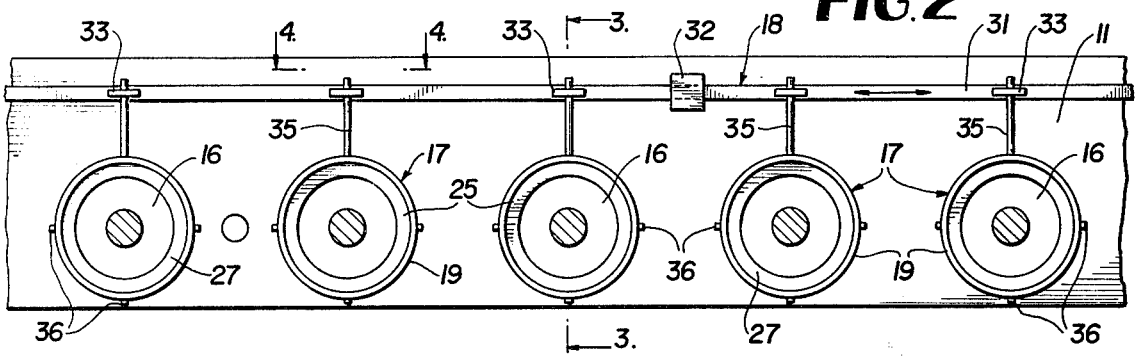
FIG. 3
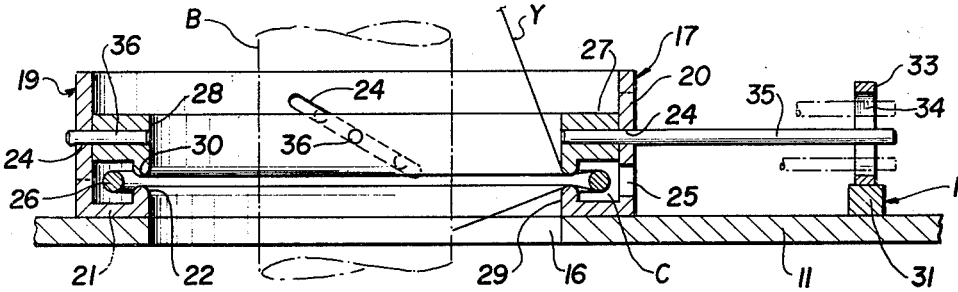
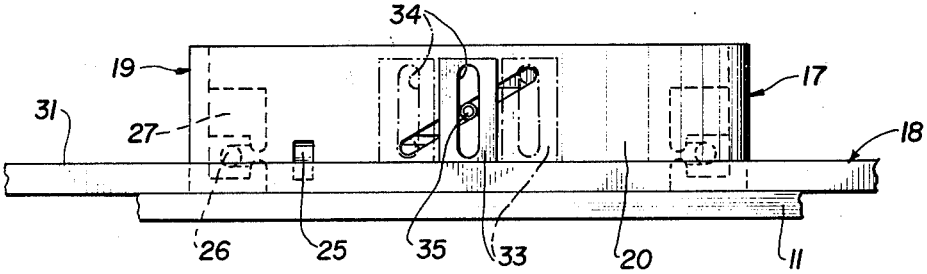
FIG. 4

YARN GUIDE FOR SPINNING OR TWISTING MACHINE

BACKGROUND OF THE INVENTION

Spinning frames typically have ring rails which rise and fall relative to rotating spools or bobbins on a fixed spindle rail, as during bobbin building. Each bobbin is surrounded by a traveler ring on the traversing ring rail and mounted for movement around the circumference of each ring is a conventional flyer or traveler. This traditional arrangement for spinning or twisting machines has advantages and drawbacks which are well known in the prior art.

It has also been proposed in the prior art to employ an annular floating ring within a fixed ring on the ring rail for a yarn guiding means in lieu of the traditional ring and flyer arrangement, and it is the objective of this invention to simplify and improve on this latter class of yarn guiding device for spinning machines. Examples of the prior patented art are to be found in the following U.S. Pat. Nos.: 877,084; 1,905,280; 2,401,249; 3,172,249.

A major improvement feature of the present invention over the prior art is the provision on the ring rail of a direct and positive gang adjusting means for the inner rings of the three ring yarn guiding devices which are provided on the ring rail adjacent to each bobbin driving spindle. The simple adjusting mechanism allows all of the inner rings of the yarn guiding devices to be raised or lowered simultaneously to vary the path of the yarn around the intermediate floating ring, thereby adjusting the yarn tension.

Another feature of the invention is the provision in the outer stationary ring of each yarn guiding device of a side wall slot through which a yarn threading implement may be inserted to facilitate threading the yarn around the exterior of the floating ring.

The invention is characterized by great simplicity, ruggedness of construction, and the elimination of any need for lubrication. The yarn tension can be adjusted through the device in exceedingly fine increments.

Other features and advantages of the invention will become apparent during the course of the following description.

BRIEF DESCRIPTION OF THE DRAWINGS

FIG. 1 is a fragmentary front elevational view of a spinning machine of the movable ring rail type having the invention applied thereto.

FIG. 2 is an enlarged fragmentary horizontal section taken on line 2—2 of FIG. 1.

FIG. 3 is an enlarged transverse vertical section taken on line 3—3 of FIG. 2.

FIG. 4 is an enlarged fragmentary rear side elevation of one yarn tensioning device and the associated gang adjusting means.

FIG. 5 is a perspective view of an outer ring employed in each yarn guiding device of the invention.

DETAILED DESCRIPTION

Referring to the drawings in detail wherein like numerals designate like parts, the numeral 10 in FIG. 1 designates the fixed spindle rail of one well known type of spinning frame having a vertically shiftable ring rail 11 which is raised and lowered by attached vertical support rods 12, guidably engaged through bushings 13 on the spindle rail 10. The traversing movement of the ring rail 11 is well known and need not be further described herein. Still referring to FIG. 1, a multiplicity of equidistantly spaced upright bobbin spindles 14 mounted on the spindle rail 10 are rotationally driven in unison by a well known tape drive system 15 of the spinning frame. For simplicity of illustration, no bobbins have been shown on the spindles 14 in FIG. 1 but the outline of a bobbin B or spool is shown in broken lines in enlarged FIG. 3.

The ring rail 11 has a plurality of spaced openings 16 formed therethrough coaxial with and surrounding the spindles 14 and their bobbins. The yarn guiding devices 17 consisting of three coacting rings and associated inner ring gang adjusting means 18 are mounted on the ring rail 11, as will now be described in detail.

Each device 17 comprises an outer ring 19 of unit construction having a comparatively thin cylindrical side wall 20 and an integral horizontal annular base wall 21 resting directly on the upper face of the ring rail 11 and suitably secured thereto fixedly. Each outer ring 19 is coaxial with one of the spindles 14 and its base wall 21, FIG. 3, follows the edge of the adjacent ring rail opening 16. Each outer ring 19 has a rising interior annular yarn guiding shoulder 22 at the inner edge or bore of the base wall 21 over which the yarn Y passes while being wound onto the bobbin B in accordance with the invention. Again referring to FIG. 1, the multiple yarns Y from overhead packages, not shown, on the spinning frame, pass downwardly through guide elements on a fixed guide rail 23 well above the ring rail 11. The rail 23 is also conventional.

The rounded guide shoulder 22 is smoothly polished and projects a comparatively small distance above the base wall 21 of the outer ring and is spaced radially inwardly of the annular side wall 20 a somewhat greater distance than the height of the guide shoulder 22 above the ring rail 11. Each outer ring 19 is provided in its side wall 20 with preferably four circumferentially equidistantly spaced straight inclined cam slots 24 for an important purpose to be described. Each outer ring also has another opening or slot 25 in its side wall and extending somewhat above the base wall 21 to facilitate threading the yarn Y around the exterior of a floating ring 26 forming another component of each yarn guiding device 17. The ring 26 is circular in cross section and comparatively small in cross section. It may be formed of polished stainless steel or the like. It is continuous around its circumference as are all of the three ring components of each device 17. As shown in FIG. 3, the diameter of the floating ring 26 is such that it can lie midway between the outer ring side wall 20 and the guide shoulder 22 of the outer ring 19.

Each yarn guiding device 17 additionally comprises a roughly rectangular cross section inner ring 27 which fits slidably inside of the outer ring 19 and has its bore 28 sized equally with the bore 29 of the outer ring. Each inner ring 27 has a depending continuous annular rounded yarn guiding shoulder 30, FIG. 3, arranged in opposing relationship to the rounded shoulder 22 of the outer ring and being smoothly polished. The annular shoulders 22 and 30 are of the same diameter. As shown in FIG. 3, the yarn Y passes through the bore of the inner ring 27, under its rounded shoulder 30, over and around the exterior of the floating ring 26 and over the shoulder 22 on its path leading to the rotating bobbin B. The previously-described opening 25 in each outer ring 19 allows the insertion of a yarn threading implement, not shown, into the chamber C where the floating ring 26 is located to facilitate threading the yarn Y around it.

The axial thickness of the inner ring 27 is slightly less than its radial thickness and much less than the axial height of the outer ring side wall 20 to allow a considerable range of axial adjustment of the ring 27 within the ring 19 to vary the guidance path of the yarn Y and the tension of the yarn in the spinning or twisting operation.

As noted previously, an important feature of the invention resides in the gang adjusting means 18 through which all of the inner rings 27 may be adjusted upwardly or downwardly simultaneously in the stationary outer rings 19. The adjusting means 18 comprises a linear shifter rod 31 extending along the back of the ring rail 11 and rearwardly of the yarn guiding devices 17. The rod 31 may be shifted longitudinally in opposite directions and held in selected adjusted positions by any conventional means, such as a screw-threaded movement means, not shown, connected with the rod 31 near one end of the ring rail 11. The rod 31 which may be rectangular in cross section, as shown, can rest slidably on the ring rail 11, and is guided during its longitudinal adjustment by a desired number of tunnel guides or bearings 32 fixed to the top of the ring rail.

Adjacent to the devices 17, the shifter rod 31 has upstanding drive elements or brackets 33 rigid therewith, which brackets are vertically slotted at 34 and slidably receive in their slots the horizontal drive pins 35. One drive pin 35 extends radially from each inner ring 27 at the rear of the yarn guiding device 17, and engages through one of the inclined camming slots 24 in the side wall 20 of outer ring 19. Shorter drive pins 36 for each inner ring 27 are anchored therein at the other three quadrants of each device 17, and these shorter pins 36 have their outer end portions engaged slidably in the other three slots 24 of the outer ring.

Consequently, with the above arrangement, when the rod 31 is shifted in one direction longitudinally, the slotted brackets 33 acting on the drive pins 35 will force them to be cammed upwardly or downwardly in the inclined slot 24 to adjust the inner ring 27 upwardly or downwardly, as the case may be. The vertical slots 34 allow the necessary upward or downward displacement of the pins 35 with the rings 27, as shown in broken lines in FIG. 3 and also in FIG. 4. When the inner rings 27 have all been adjusted to the desired heights in the outer rings 19 by the gang adjusting means, the rod 31 is locked against further movement and the rings 27 will all remain in the selected adjusted position to provide the desired tension on all of the yarns Y.

With the guiding devices 17 properly adjusted and with the spindles 14 rotating, the yarns Y will follow paths between the shoulders 22 and 30 and around the outside of the floating ring 26 as illustrated in FIG. 3 while the yarns travel circumferentially around the floating ring which will normally remain in one position when proper adjustments have been made. The friction between the yarn and the shoulders 22 and 30 and the floating ring is very minimal and the guiding devices 17 operate with great efficiency. The structure is characterized by great simplicity and economy of manufacturing costs and can be installed on practically any spinning machine. Its many advantages over the prior art should now be apparent.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a spinning machine, a ring rail to traverse bobbins during the winding thereof, rotating spindles carrying the bobbins, and yarn guiding devices on the ring rail and surrounding the spindles, each yarn guiding device comprising an outer ring fixed to the top of the ring rail and having a side wall, an inner ring within the outer ring and adapted for vertical adjustment therein and an intermediate floating ring within the outer ring and inner adjustable ring, and adjusting means common to all of the yarn guiding devices on the ring rail and having a connection with each inner adjustable ring and being operable to raise or lower the inner adjustable rings of all of the devices in unison to vary yarn tension.

2. In a spinning machine as defined in claim 1, and each outer ring and inner adjustable ring having axially opposing continuous rounded yarn guiding shoulders, and said intermediate floating ring being a circular cross section continuous ring lying radially outwardly of said shoulders and inwardly of the side wall of the outer ring, whereby a yarn can pass through the inner ring and beneath the rounded shoulder thereof and around the exterior of the floating ring and over the rounded shoulder of the outer ring.

3. In a spinning machine as defined in claim 2, and the outer ring having a flat annular base wall extending radially inwardly of the annular side wall of the outer ring and being axially opposed to the inner ring and the rounded annular shoulder of the outer ring rising from said base wall at the inner edge thereof.

4. In a spinning machine as defined in claim 3, and the side wall of the outer ring having at least one yarn threading aperture formed therethrough.

5. In a spinning machine as defined in claim 1, and said adjusting means comprising a shifter rod extending longitudinally of the ring rail and spaced from corresponding sides of the yarn guiding devices and guidably connected with the ring rail whereby it may be shifted longitudinally in opposite directions, radial pins anchored in the inner rings of said devices, inclined guide slots in the side walls of the outer rings of said devices receiving said pins cammingly, and drive elements secured to and projecting from the shifter rod at spaced intervals therealong and having lost motion connections with one radial pin of each inner ring.

6. In a spinning machine as defined in claim 5, and each lost motion connection comprising a slotted drive element on the shifter rod and the slot of such drive element slidably receiving said one radial pin of each inner ring.

7. A yarn guide for spinning machines comprising an outer ring including a base wall adapted to be fixed on a spinning machine ring rail, an inner ring having a bottom within the outer ring and adapted to move axially therein, axially opposing rounded annular yarn guiding shoulders on the outer and inner rings, a floating ring within the outer ring and between the bottom of the inner ring and a base wall of the outer ring and lying radially outwardly of said opposing rounded annular shoulders, and camming means connected with the inner ring to raise and lower it axially in the outer ring.

8. A yarn guide for spinning machines as defined in claim 7, and said camming means comprising an inclined side wall slot in the outer ring, a radial pin anchored to the inner ring and extending through said slot of the outer ring, and driver means connected with said radial pin exteriorly of the outer ring to shift it in opposite directions within said inclined slot to thereby cause upward or downward adjustment of the inner ring within and relative to the outer ring.

9. A yarn guide for spinning machines as defined in claim 8, and said driver means comprising an oppositely axially shiftable rod, a slotted drive element carried by the rod, and said radial pin engaging through the slot of said drive element.

10. A yarn guide for spinning machines as defined in claim 7, and a plurality of the yarn guide units consisting of outer rings, inner rings and floating rings, and said camming means including a drive element projecting from the inner ring of each unit, and a shifter element common to all of the drive elements and having a connection with each drive element whereby movement of the shifter element in opposite directions will simultaneously raise or lower the inner ring of each unit.

* * * * *